US005631685A

United States Patent [19]

Gooray et al.

[11] Patent Number: 5,631,685

[45] Date of Patent: May 20, 1997

[54] APPARATUS AND METHOD FOR DRYING INK DEPOSITED BY INK JET PRINTING

[75] Inventors: Arthur M. Gooray; Kenneth C. Peter, both of Penfield, N.Y.; Murray D. Sirkis, Tempe, Ariz.

[73] Assignee: Xerox Corporation, Stamford, Conn.

[21] Appl. No.: 159,908

[22] Filed: Nov. 30, 1993

[51] Int. Cl.[6] ..... B41J 2/01; H05B 6/64

[52] U.S. Cl. ..... 347/102; 34/259; 101/488; 219/692

[58] Field of Search ..... 347/102, 42; 219/700, 219/701, 692; 34/264, 259; 101/488, 424.1; 355/287

[56] References Cited

U.S. PATENT DOCUMENTS

| | | | |
|---|---|---|---|
| 2,560,903 | 7/1951 | Stiefel | 219/693 |
| 3,434,220 | 3/1969 | Forster | 34/264 |
| 3,463,894 | 8/1969 | Bleackley | 219/693 |
| 3,471,672 | 10/1969 | White | 219/692 |
| 3,584,389 | 6/1971 | Hilton et al. | 34/1 |
| 3,617,953 | 11/1971 | Kingma et al. | 333/17 |
| 3,672,066 | 6/1972 | Stephansen | 34/1 |
| 3,739,130 | 6/1973 | White | 219/10.55 |
| 3,783,414 | 1/1974 | Klein et al. | 333/22 |
| 3,796,973 | 3/1974 | Klein | 333/22 |
| 4,234,775 | 11/1980 | Wolfberg et al. | 219/692 |
| 4,286,135 | 8/1981 | Green et al. | 219/10.55 |
| 4,332,091 | 6/1982 | Bensussan et al. | 34/1 |
| 4,352,691 | 10/1982 | Owatari et al. | 106/20 |
| 4,469,026 | 9/1984 | Irwin | 101/426 |
| 4,482,239 | 11/1984 | Hosono et al. | 355/3 |
| 4,754,238 | 6/1988 | Schüller et al. | 333/22 |
| 4,970,528 | 11/1990 | Beaufort et al. | 347/102 X |
| 5,079,507 | 1/1992 | Ishida et al. | 324/645 |
| 5,207,824 | 5/1993 | Moffatt et al. | 106/22 |
| 5,214,442 | 5/1993 | Roller | 347/102 |
| 5,220,346 | 6/1993 | Carreira et al. | 347/102 |
| 5,278,375 | 1/1994 | Berteaud et al. | 219/693 |
| 5,349,905 | 9/1994 | Taylor | 347/102 X |
| 5,371,531 | 12/1994 | Rezanka | 347/102 X |
| 5,410,283 | 4/1995 | Gooray | 347/102 X |
| 5,422,463 | 6/1995 | Gooray | 347/102 X |

FOREIGN PATENT DOCUMENTS

| | | | |
|---|---|---|---|
| 0089288 | 3/1983 | European Pat. Off. | H05B 6/78 |
| 538071A2 | 4/1993 | European Pat. Off. | B41J 2/17 |
| 55-107490A | 8/1980 | Japan | B41J 3/04 |
| 1050493 | 12/1966 | United Kingdom | H05G 9/00 |

OTHER PUBLICATIONS

Van Kooghnett et al; A Microwave Dryer for Ink Lines; Journal of Microwave Power, 7(4), 1972, pp. 347–351.

Gilbert M. Elchinger, "Electrostatic Dryer for Ink Jet Printers", Xerox Disclosure Journal, vol. 7, No. 6, Nov./Dec. 1982, pp. 373–375.

*Primary Examiner*—Joseph W. Hartary

*Attorney, Agent, or Firm*—Daniel J. Krieger

[57] ABSTRACT

An apparatus for drying ink deposited upon cut sheet of paper. The apparatus includes a microwave generating member to generate microwave energy for the ink and an applying member connected to said microwave generating member to apply resonating traveling microwaves to the paper. The applicator member includes a serpentine applicator for drying the ink and includes input slots and output slots for moving cut sheet of paper through the serpentine applicator. A transport member transports ink printed cut sheet paper stock from the input slot to the output slot by a belt running through the center of the applicator.

41 Claims, 18 Drawing Sheets

APPARATUS AND METHOD FOR DRYING INK DEPOSITED BY INK JET PRINTING

CROSS-REFERENCE TO RELATED APPLICATION

Cross-reference is made to patent application Attorney Docket No. D/92371, U.S. patent application Ser. No. 08/159,358, now U.S. Pat. No. 5,422,463 entitled "Dummy Load for Microwave Dryer" and patent application Attorney Docket No. D/93144, U.S. patent application Ser. No. 08/160,002, now U.S. Pat. No. 5,410,283 entitled "Phase Shifter for Fine Tuning Microwave Applicator" being filed concurrently herewith.

FIELD OF THE INVENTION

The present invention relates generally to drying ink deposited by an ink jet printer and more particularly relates to an apparatus and method for controlling paper deformation due to ink jet printing by the use of microwave energy.

BACKGROUND OF THE INVENTION

Many inks and particularly those used in thermal ink jet printing include a colorant and a liquid which is typically an aqueous liquid vehicle. Some thermal ink jet inks also include a low vapor pressure solvent. When a substrate or a sheet of paper is printed with ink jet ink, the ink is deposited on the substrate to form an image in the form of text and/or graphics. Once deposited, the liquid is removed from the ink and paper to fix the ink to the substrate. The amount of liquid to be removed, of course, varies with the amount of ink deposited on the substrate. If a sheet is covered with 10% printing, as in text only printing, the amount of liquid to be removed is quite small. If the sheet is covered with 90% printing, however, as when a graphic image is printed, the amount of liquid to be removed is substantially more and can cause image defects and paper deformation if not removed very rapidly.

Liquid can be removed from the ink and printed substrate by a number of methods. One simple method is natural air drying in which the liquid component of the ink deposited on the substrate is allowed to evaporate without mechanical assistance resulting in natural drying. Another method is to send the printed substrate through a dryer to evaporate the liquid. In some cases a special paper is used in which the liquid is absorbed by a thin coating of absorptive material deposited on the surface of the paper. Blotting of the printed substrate is also known.

In the case of natural drying, almost 100 percent of the liquid is absorbed into the paper and is then, over a long period of time, evaporated naturally. The absorption and desorption of water into and out of the paper, however, has some undesirable side effects, such as long drying time, strike through, feathering at edges of the printed image, paper curl and paper cockle. In the case of paper cockle, the absorption and desorption of the water relaxes the internal stresses of the paper and results in deformations known as cockle. Cockle is also a function of the amount of liquid deposited per unit area. Less printing on a page has less potential to develop cockle due to the smaller amount of liquid. More printing on a page has more cockle potential due to a higher amount of liquid per unit area. Cockle can also be induced by heating of the paper, which results in stress relief.

Ink compositions also have an effect on the drying rates and drying efficiency. For example, highly absorptive (fast drying) inks while requiring less ink to be removed by a dryer are prone to image quality defects such as feathering, raggedness, and strike through. On the other hand, slightly absorbtive inks require more power from a dryer to dry since more ink requires evaporation.

The rate at which the image is dried is also critical for controlling the print quality. A slow drying rate can achieve ink permanence or drying effectiveness but also can result in image quality defects such as excessive image feathering or strike through. Additionally, a slow drying rate can result in image offset (ink from one sheet of paper is transferred to another sheet of paper because the ink has not dried completely), smear and spreading from contact with exit rolls, baffles and output stacking of the individual sheets. A very fast drying rate can result in image mottle and image spatter.

Drying rates are particularly critical when substrates are printed at high rates of speeds. Not only must image deformations and paper deformations be controlled, but the drying times must be short due to the high printing rates to ensure no offset at exit rolls.

A dryer must achieve image fixing (no offset/smear) and good image quality to reduce or prevent image disturbance, distortion, feathering and strike through. In addition the dryer must preferably reduce or eliminate cockle and curl. Besides the slow speed of conventional dryers, many dryers produce uneven drying rates resulting in uneven drying patterns. To shorten drying times, infrared drying techniques have been adopted. This method can, however, cause browning of paper during paper jams due to the elevated temperatures produced by the infrared heat.

In U.S. Pat. No. 3,584,389 to Hilton et al., a method and apparatus for drying printing ink on paper in which both microwave and infra-red radiation used for heating is described. A web of printed paper on which the print is to be dried passes through two serpentine slotted waveguides in succession, and thereafter passes under three infra-red heaters.

U.S. Pat. No. 3,617,953 to Kingma et al. describes a microwave impedance matching system for matching a microwave input waveguide to a microwave output waveguide. A first and second electromechanical phase shifter are moved transversely in waveguide sections to produce varying amount of differential phase shift.

U.S. Pat. No. 3,672,066 to Stephansen discloses a microwave drying apparatus which includes a serpentine waveguide The device includes two opposed air cushions which force a web of material passing through the device to stay midway between the opposite waveguides.

U.S. Pat. No. 3,739,130 to White, discloses a multicavity microwave applicator for uniformly treating a moving web of material with microwave energy. The applicator is formed of two separate sets of cavity resonators which are intermeshed with one another so that the resonators of one set are alternated with the resonators of the second set in a side-by-side relationship.

U.S. Pat. No. 3,783,414 to Klein et al. describes a termination for a transmission line or waveguide of small weight and size capable of absorbing high levels of power and capable of achieving a VSWR in the order of 1.05 to 1.20 over 10–20 percent frequency bands.

U.S. Pat. No. 3,796,973 to Klein describes a termination for transmitting or absorbing a signal transmitted through a transmission line or waveguide.

U.S. Pat. No. 4,234,775 to Wolfberg et al. discloses a device which has a serpentine waveguide and uses microwave energy to remove moisture from a moving web. The microwave energy takes the form of standing waves which are purposefully disrupted to cause the peaks of the standing waves to continuously oscillate along the various sections of the waveguide, resulting in a more uniform application of the microwave energy across the width the web.

U.S. Pat. No. 4,286,135 to Green et al. describes a waveguide isolator having microwave ferrite bars to reduce energy reflected into the microwave source. A blower fan draws air past the microwave source and through a waveguide to provide cooling.

U.S. Pat. No. 4,332,091 to Bensussan et al. describes a microwave drying device intended for drying grains having a phase shifter allowing the phase to be adjusted to obtain maximum efficiency of the device.

U.S. Pat. No. 4,352,691 to Owatari et al. describes liquid ink compositions including a water-soluble dye, an alkali material, at least one wetting agent and water suited for ink jet type printers. Ink drying time is about five seconds.

U.S. Pat. No. 4,469,026 to Irwin describes a method and apparatus for drying ink printed on print media. Drying is controlled according to print parameters such as print data density, characteristics of the ink, and ambient humidity. The dryer may be a conventional hot roll, a hot platen, a lamp or a microwave dryer.

U.S. Pat. No. 4,482,239 to Hosono et al. describes an electrophotographic copying machine which visualizes electrostatic latent images with developer fixed by microwave radiation. The developer is a colored developing powder composed of thermoplastic resin having a high dielectric constant and magnetic powder having magnetic loss.

U.S. Pat. No. 4,754,238 to Schuller et al. describes a microwave absorber including a hollow body consisting of microwave-absorbing material which is arranged in a housing. At least one inlet and one outlet are provided for a gaseous cooling fluid which streams through the container to carry away heat produced by microwave energy which has been absorbed by the absorbing body.

U.S. Pat. No. 4,970,528 to Beaufort et al. describes a method for uniformly drying ink on paper from an ink jet printer. While paper is transferred from an input paper supply tray to an output paper collection tray, the paper receives the uniform heat flux from an infrared bulb which is located on the axis of symmetry for the paper transport path. The per page processing speed for this apparatus was increased from 2 minutes per page using no dryer at all, to 13 seconds per page using the described uniform dryer.

U.S. Pat. No. 5,079,507 to Ishida et al. describes an automatic impedance adjusting apparatus for adjusting an impedance seen looking toward a microwave load. A cooling air outlet exhausts cooling air into a circular waveguide.

U.S. Pat. No. 5,207,824 to Moffatt et al. describes ink formulations for control of paper cockle in thermal ink jet printing. The ink contains the components of water, dye, and a low vapor pressure solvent, which contains an organic compound or anti-cockle agent.

U.S. Pat. No. 5,214,442 to Roller describes an adaptive dryer to minimize heating power requirements of a printer by determining mass-area coverage of ink on a page prior to drying.

U.S. Pat. No. 5,220,346 to Carreira et al. describes a printing process using an ink composition comprising an aqueous liquid vehicle, a colorant and an ionic compound at least partially ionizable in the liquid vehicle applied to a substrate in an imagewise fashion and subsequently exposed to microwave radiation to dry the images on the substrate.

British Patent Specification No. 1,050,493 to Hilton describes microwave heating and/or drying of sheet material, for example paper in order to dry ink which has been applied by a printing process. The apparatus comprises a plurality of waveguide sections provided with slots in the sides thereof through which a sheet of material can be passed for drying. The waveguide sections are arranged in a serpentine manner. A microwave source is attached to one end of the waveguide and a load is attached to the other end of the waveguide.

Japanese Laid Open Publication 107,490 to Yamaguishi describes an apparatus to dry ink printed out by means of an ink jet printer by utilizing a microwave.

European Patent Application Publication No. 538 071-A2 to Yasuhiko et al. describes an ink jet recording apparatus having a low temperature heater and a high temperature heater to dry the ink. The low temperature heater heats the recording sheet and the high temperature heater heats the ink recorded on the recording sheet to a temperature at which the ink is dried and fixed.

Xerox Disclosure Journal, Volume 7, Number 6, November/December 1982, pages 373 to 375 describes an electrostatic dryer for ink jet printers.

SUMMARY OF THE INVENTION

In accordance with one aspect of the present invention, there is provided an apparatus for drying ink deposited on a cut sheet of paper. The apparatus for drying ink includes a microwave generating member, an applying member to apply microwave power to the paper, and a transport member for transporting the paper through the applying member.

Pursuant to another aspect of the present invention, there is provided a method for drying ink deposited on a cut sheet of paper by applying microwave power using a microwave dryer generating resonating traveling waves to the deposited ink within about five seconds or less after depositing the ink on the paper and removing excess liquid from the deposited ink through continued application of the microwave power. The short time period between printing and drying is essential for paper deformation control.

Further aspects of the invention include providing a printing machine having an ink jet printhead, a microwave dryer for drying the ink deposited on cut sheet paper, and a transport member for transporting the cut sheet paper through the microwave dryer. Likewise, a method of printing and drying ink on a cut sheet of paper is also provided by depositing ink on the cut sheet of paper by an ink jet printhead, passing the sheet of paper to a microwave dryer immediately after the deposition of ink, and rapidly heating the ink by microwave power to evaporate liquid in the ink and paper before substantial absorption of the ink into the paper.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention. Consequently, many modifications and variations are possible in light of the teachings herein by those skilled in the art as expressed in the specification and the appended claims.

DETAILED DESCRIPTION OF THE INVENTION

Figure 1:
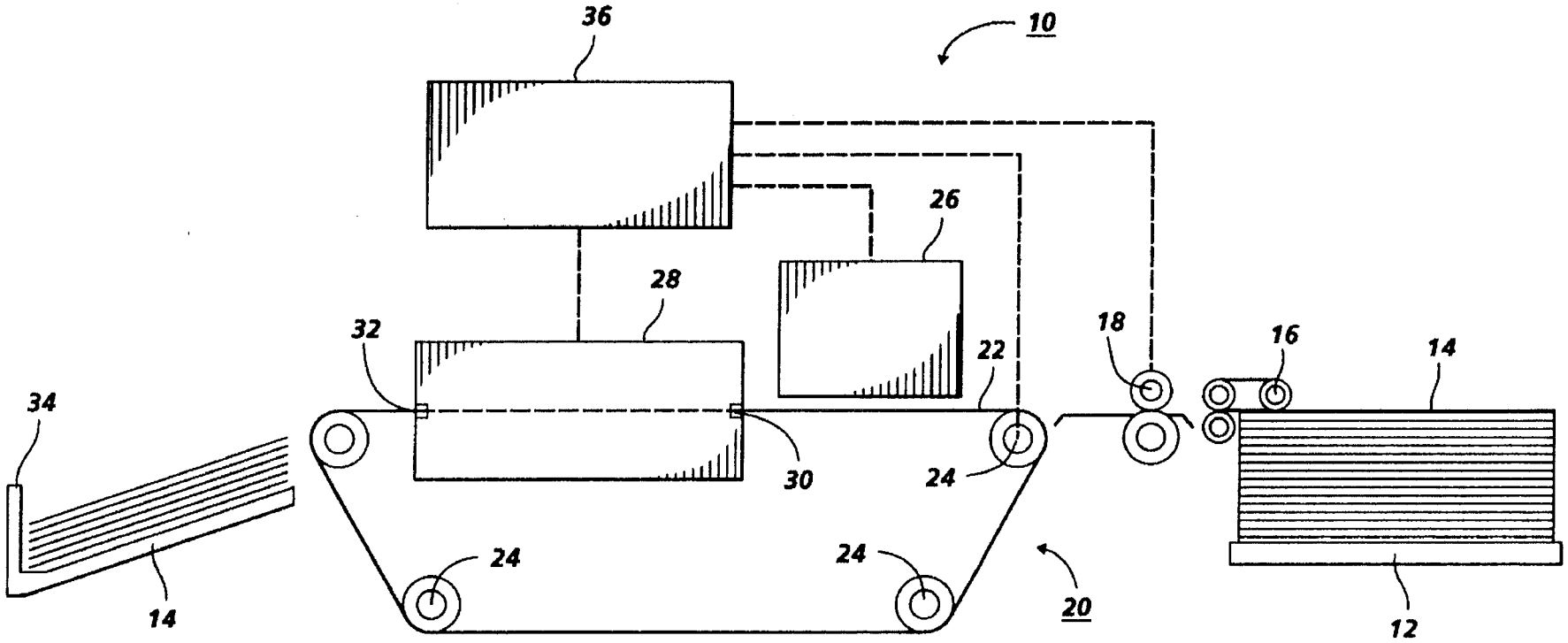
FIG. 1 is a schematic view of an ink jet printer suitable for use with the present invention.

FIG. 1 illustrates a schematic view of an ink jet printer 10 of the present invention. The ink jet printer 10 includes an input tray 12 containing cut sheets 14 of paper stock to be printed upon by the ink jet printer 10. Single sheets 14 of paper are removed from the input tray 12 by a pick-up roller 16 and fed by feed rollers 18 to a paper transport mechanism 20. The paper transport mechanism 20 moves the sheet 14 by a feed belt or belts 22 driven by rollers 24 beneath a printing member 26. The belts 22 are made of a material transparent to microwave power having a low dielectric constant. The printing member 26 includes a pagewidth ink jet printhead which deposits ink on the sheet 14 as the sheet moves past the printhead. The pagewidth ink jet printhead is a linear array of print nozzles as wide as the sheet so that ink is deposited across the entire width of a sheet. The present invention is equally applicable, however, to printers having an ink jet printhead which moves across the sheet 14 periodically, in swaths, to form the image, much like a typewriter. The print member 26 includes an ink supply and the necessary electronics to control the deposition of ink on the page.

Preferably, ink specially formulated to be heated by microwave power is used. Such ink may include compounds designed to couple with the microwave power for increasing the amount of heat conducted thereby. One such compound is an ionic compound at least partially ionizable in the liquid vehicle. U.S. Pat. No. 5,220,346, entitled "Printing Processes with Microwave Drying", assigned to Xerox Corporation, discloses a suitable ink and is hereby incorporated in this application by reference.

Once the sheet 14 has been printed, the sheet 14 is carried by the paper transport, immediately after printing or within about 5 seconds or less, to a microwave dryer 28. The sheet enters an input slot 30 and exits an output slot 32. A transport mechanism, such as one using a vacuum applied to the bottom side of the paper or one using a static mat carries the paper through the microwave dryer 28. As the sheet 14 passes through the microwave dryer 28, microwave power is delivered to the sheet 14 to thereby dry the ink deposited thereon. Once the sheet 14 is substantially dry, the sheet is sent to an output tray 34.

A controller 36 controls the printing member 26, the microwave dryer 28, and the paper transport mechanism 20 as would be understood by one skilled in the art. In addition, an adaptive dryer control for ink jet processors can also be used. U.S. Pat. No. 5,214,442, entitled "Adaptive Dryer For Ink Jet Processors", assigned to Xerox Corporation, discloses such an adaptive dryer control and is hereby incorporated in this application by reference.

Microwave dryer 28 has such a fast drying rate that the excess liquid in the ink on the substrate is evaporated from the surface of the printed sheet before any appreciable absorption occurs. Additionally, microwave power generated in the dryer 28 produces an electric field sufficiently large to effectively dry a thin layer of ink on the paper substrate.

To control image quality defects in the ink jet printer 10, ink is deposited on the substrate from printhead 26, and the printed substrate is passed to dryer 28 for rapid drying. Preferably, the substrate travels through dryer 28 at a speed ranging from about 2 inches to 20 inches per second, or from about 10 prints to 200 prints per minute. In the printer 10 described above, input slot 30 is located approximately three inches from printhead 26. With the paper speed of 2 to 20 inches per second, the total time from depositing the ink on the substrate to entering the dryer is approximately 1.5 seconds to 0.15 seconds. Thus, using a serpentine dryer, for example, with a total drying zone of 6.75 inches, the substrate exits the dryer in 5 to 0.5 seconds.

Figure 2A:
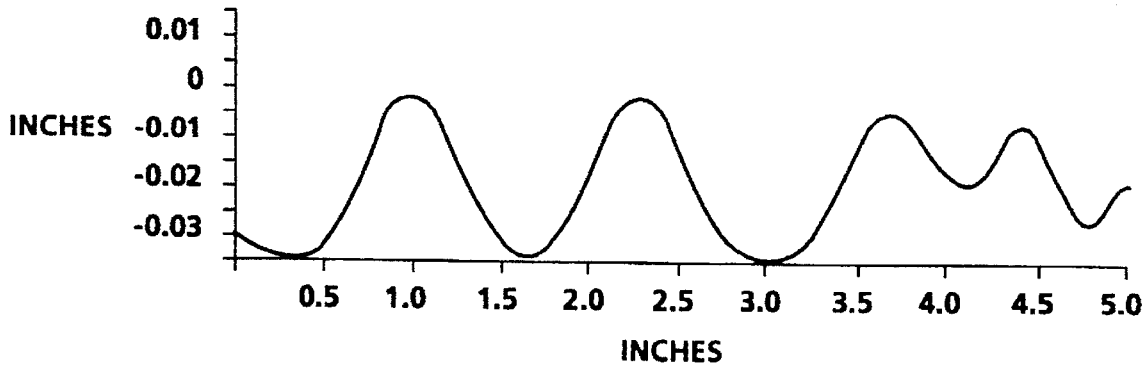
FIG. 2*a* is a graph of the cockle profile of a non-microwave dried image.
Figure 2B:
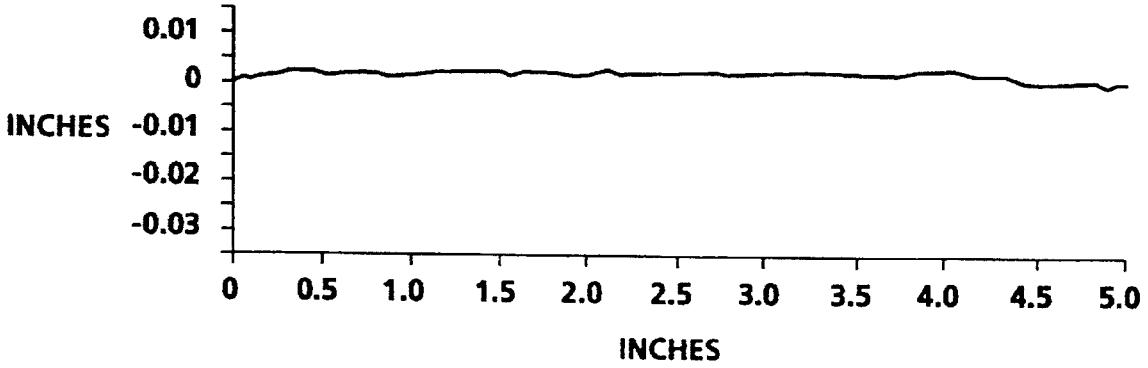
FIG. 2*b* is a graph of the cockle profile of a microwave dried image in accordance with the present invention.

Drying of the ink should begin in no more than 3 to 5 seconds from the time the ink is deposited to reduce image quality defects such as cockle/curl, feathering and strike through. FIG. 2*a* is a graph of the cockle profile for non-microwave dried ink. In comparison, FIG. 2*b* shows the cockle profile of microwave dried ink. The microwave dried ink has a generally flat profile, whereas the non-microwave dried ink has an uneven, choppy profile. Also, microwave dried ink does not show through the back of the substrate or paper as opposed to non-microwave dried ink which has a tendency to show through the other side.

Figure 2C:
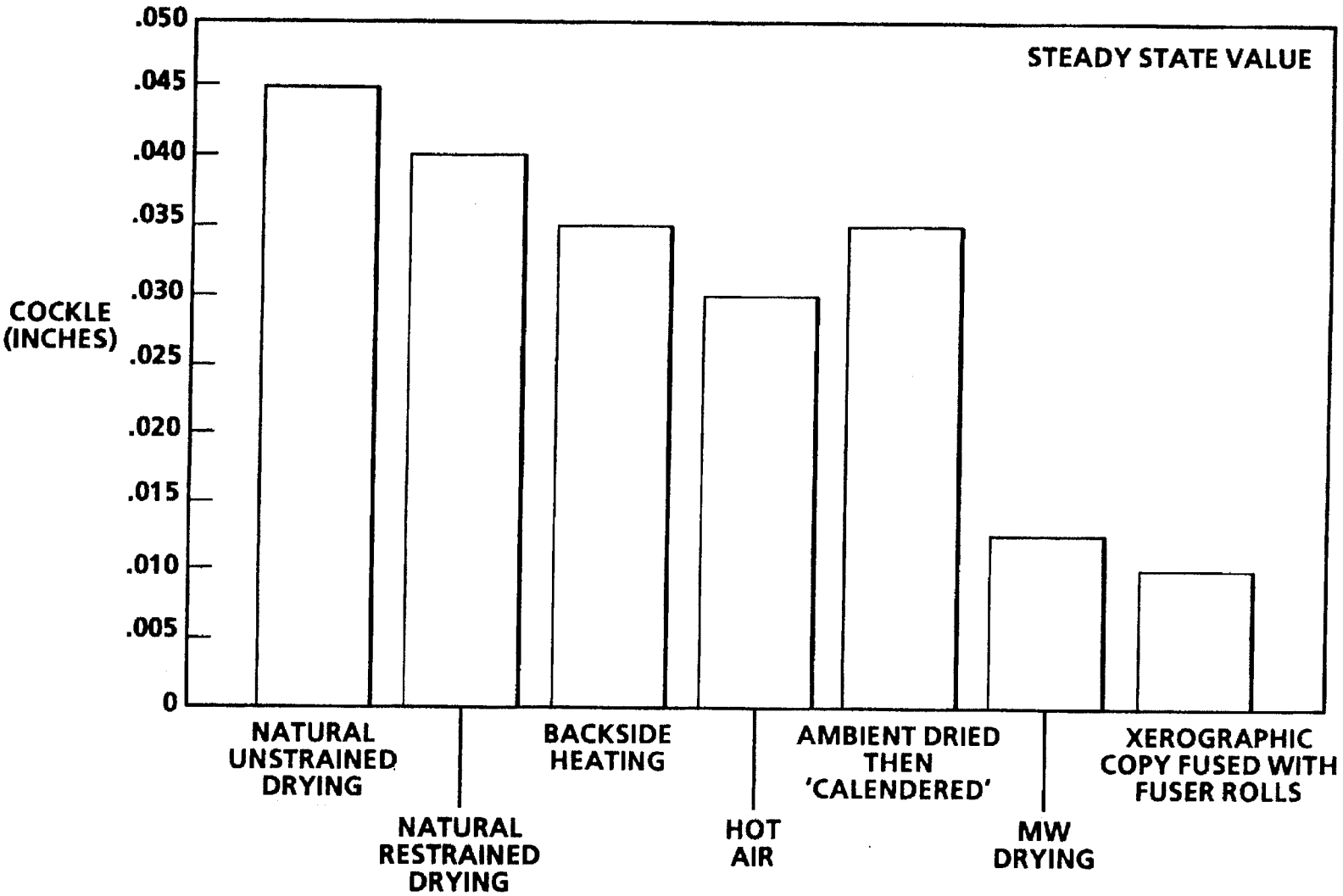
FIG. 2*c* is a bar graph showing the final steady state cockle for various drying modes.

FIG. 2*c* shows average cockle magnitudes for various drying modes and for Xerographic copying. The bars for each category represent average heights of cockle in inches. The sample paper used for this experiment was Xerox 4024 20# Champion Courtland. It can be seen from this graph that microwave dried images have significantly reduced cockle, close to the cockle of an image produced by Xerographic copying. It is preferable to keep cockle height below 15 mil.

Figure 2D:
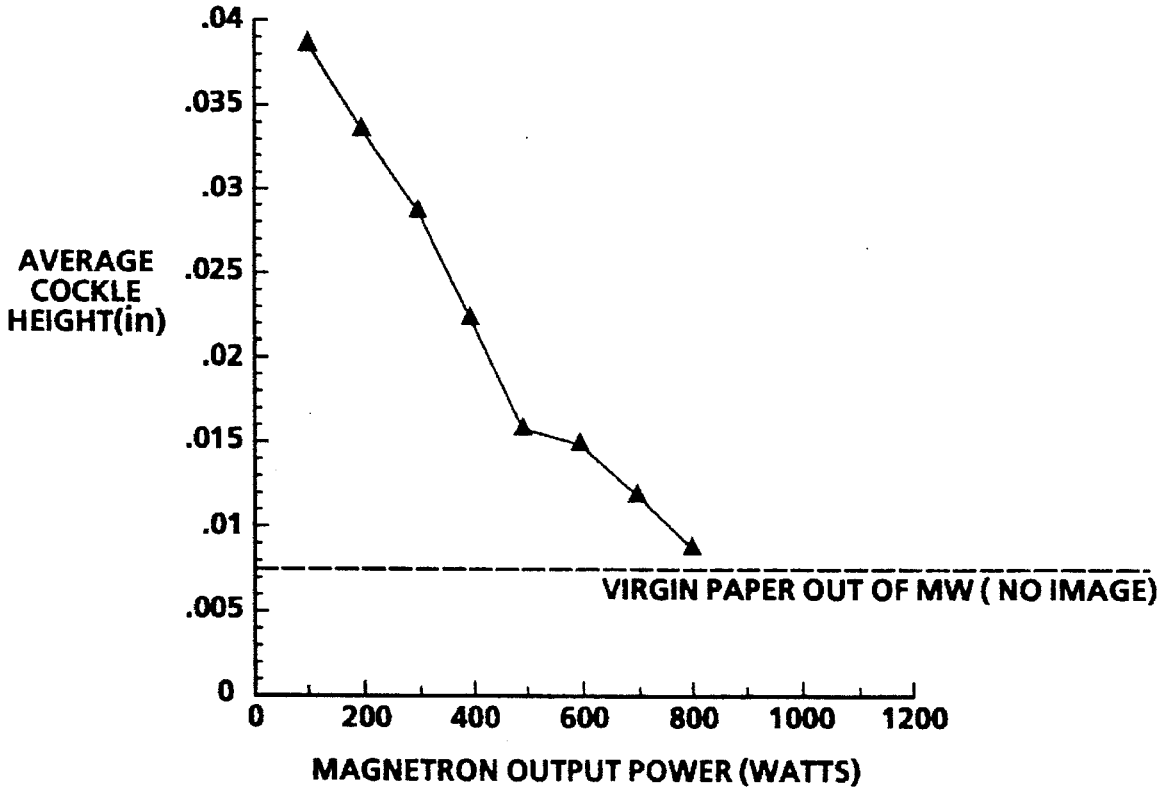
FIG. 2*d* is a graph showing cockle reduction as a function of increasing microwave drying rate.

FIG. 2*d* shows the way in which the average cockle magnitude decreases with increasing magnetron output power. As the magnetron power increases, the cockle magnitude decreases, approaching cockle of virgin paper run through a microwave dryer having no image. Also, as the heating rate increases, drying time is reduced and cockle growth is suppressed. In this experiment, Courtland 4200 paper 5.2% MC, full tone, 1.8 mg/cm$^2$ ink density was used, and the conditions for the test were 73° F. ambient and 65% relative humidity. The paper had a 5 inches per second (IPS) travel rate, and time between printing and exit of dryer was 4 seconds.

Figure 2E:
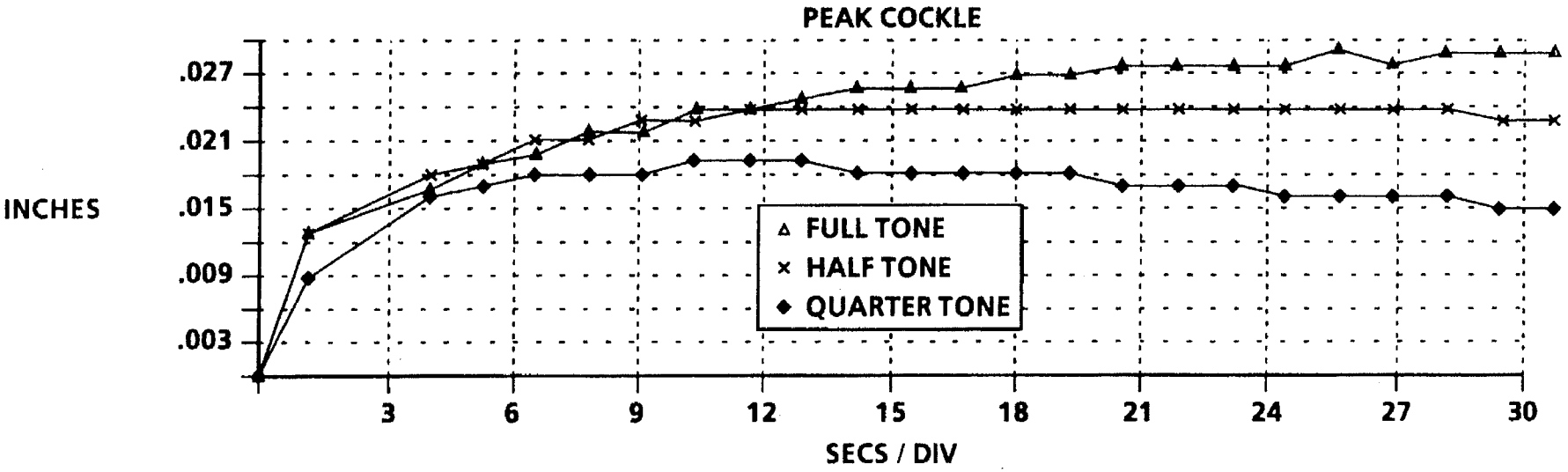
FIG. 2*e* is a graph showing the amount of cockle versus time with no active drying by allowing ambient drying.

FIG. 2*e* is a graph showing the amount of cockle or cockle height versus time with no active drying for full tone (1.6 mg/cm$^2$), half tone (0.8 mg/cm$^2$) and quarter tone (0.4 mg/cm$^2$) printing of carbon black ink, with 0.25 inches of $H_2O$ hold down of the sheet. As can be seen, cockle height shown in inches increases rapidly until approximately 3 seconds at which time cockle height begins to gradually level off. If cockle height is to be controlled or suppressed drying must be applied within about 3 to 5 seconds after printing.

Figure 2F:
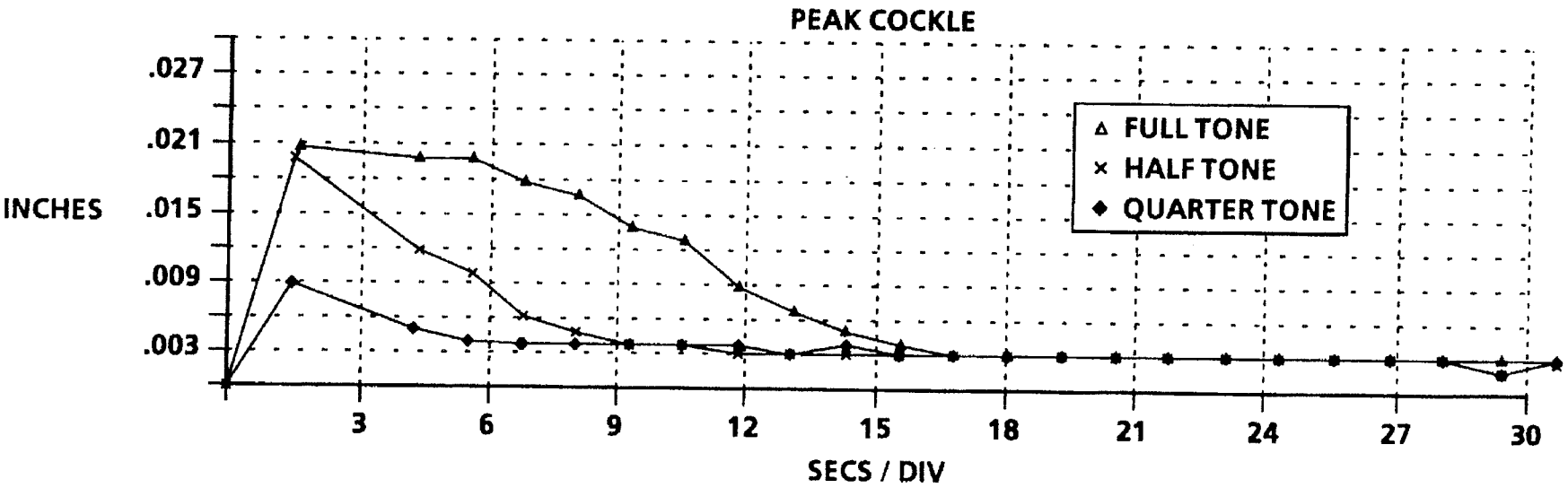
FIG. 2*f* is a graph showing the amount of cockle versus time with active drying by contacting the sheet on a heated platen.

FIG. 2*f* is a graph showing the amount of cockle versus time with active drying using a 100° C. platen for test purposes. Again, measurements were made for full tone, half tone and quarter tone printing of carbon black ink with 2" of $H_2O$ holdown. FIG. 2*e* shows that if a full tone printed sheet is dried in less than 5 seconds, cockle height can be effectively suppressed. In this example, the image is dried in about 5 seconds, and the cockle is suppressed when compared to FIG. 2*e*. After 5 seconds, the curve for full tone drops off rapidly, indicating the paper equilibrates to a lower cockle height once dry. With a faster heating rate as in the case of microwave drying, cockle is suppressed much more rapidly.

Figure 3A:
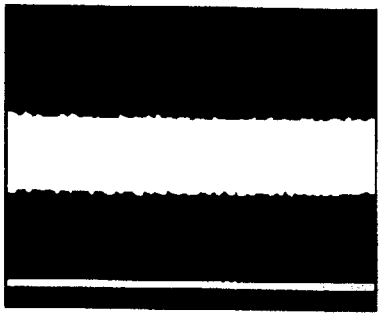
FIG. 3*a* is a sample panel of a tri-color non-microwave dried image with intercolor bleed.
Figure 3B:
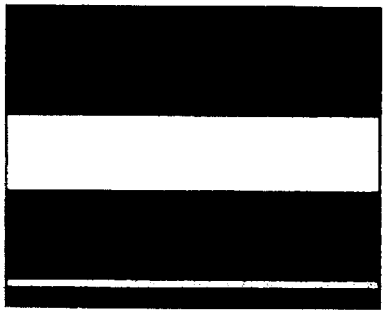
FIG. 3*b* a sample panel of a tri-color microwave dried image in accordance with the present invention.

FIGS. 3*a* and 3*b* illustrate bleeding between colors. FIG. 3*a* shows an ambient dried tri-color panel of ink in which the outer two darker colors have bled into the lighter interior panel. FIG. 3*b*, on the other hand, shows a microwave dried tri-color panel in which the colors have not bled together at their interface. Thus, it can be seen that image quality is greatly enhanced by rapid drying. It is important to deliver the printed sheet to the microwave dryer before significant bleed occurs. The application of microwave power will then stop any additional bleed. In addition, microwave heating is very effective in halting and controlling image quality defects immediately after exposure since the internal heating of absorbed ink insures that all the moisture is driven out by evaporation.

Figure 4A:
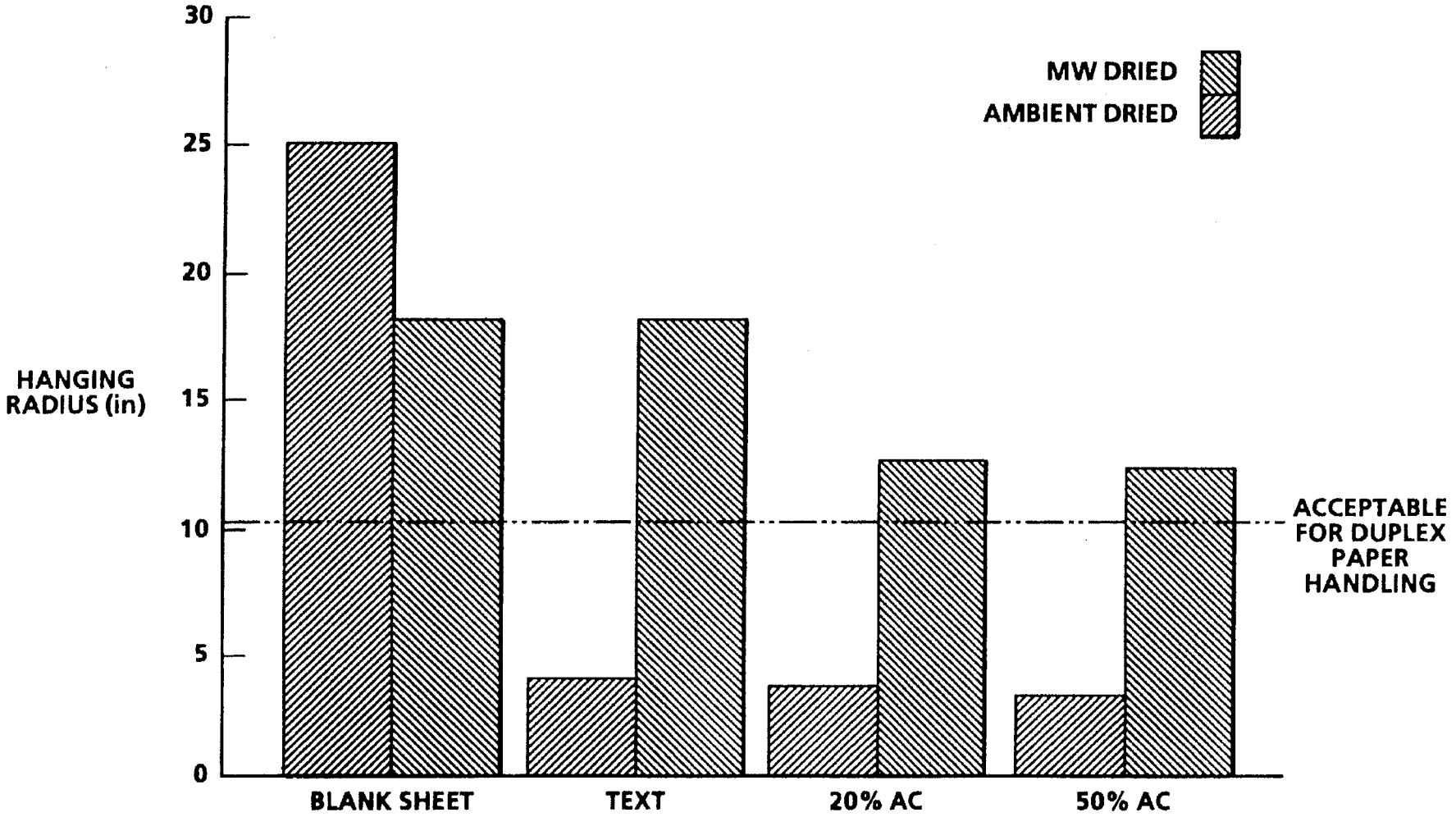
FIG. 4*a* is a bar graph illustrating hanging radius curl for both ambient (natural) and microwave dried images.

FIG. 4*a* shows the output curl magnitudes for various area coverage for both ambient (natural air drying) and microwave drying measured at the output slot 32. The hanging radius curl characterizes the flatness of the sheet, i.e., the greater the hanging radius curl, the flatter the sheet. Very flat paper has a hanging radius of greater than 20 inches but paper having a hanging radius of greater than 10 inches is acceptable for paper handling (Duplex Feeder). In every tested example, as seen by the graph, the microwave dried sheet has a greater hanging radius curl. The paper used in these tests was 4024 20# Champion Courtland run at 5 IPS on the test fixture with an initial MC equal to 4.9%, and the ink used was the ink disclosed in co-pending U.S. Pat. No. 5,220,346.

Figure 4B:
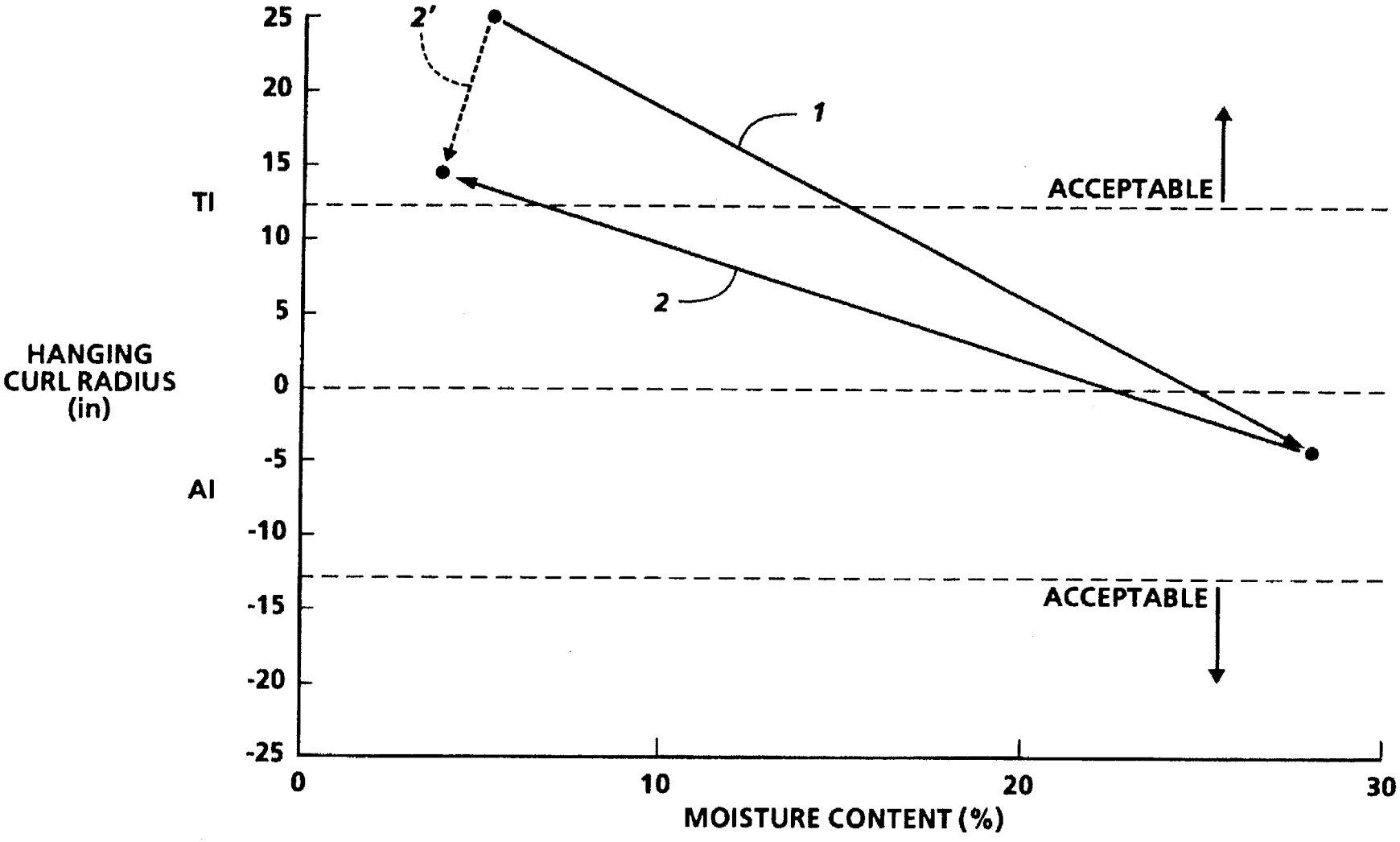
FIG. 4*b* shows the hanging radius curl state with and without microwave drying.

FIG. 4*b* shows the hanging radius curl state before and after microwave drying for virgin paper, printed paper, microwave dried virgin paper and microwave dried printed paper of Champion/Courtland 20# paper having ambient moisture content. As shown, hanging radius curl is considered to be acceptable if the curl exceeds approximately 12 inches in either direction. Tl indicates that the curl is towards the image and Al indicates the curl is away from the image. For no drying, shown as line 1, the paper, after printing with 100% area coverage and exiting the printing zone, approaches in the direction of the arrow, unacceptable levels of hanging radius curl. The sheet now enters the microwave dryer just after printing with ink, shown as line 2. As moisture content is reduced by microwave drying, the hanging radius curl improves to the point of acceptability. The dotted line 2' indicates the drying of virgin paper without printing which goes from approximately 25 inches to 15 inches of curl.

Figure 5:
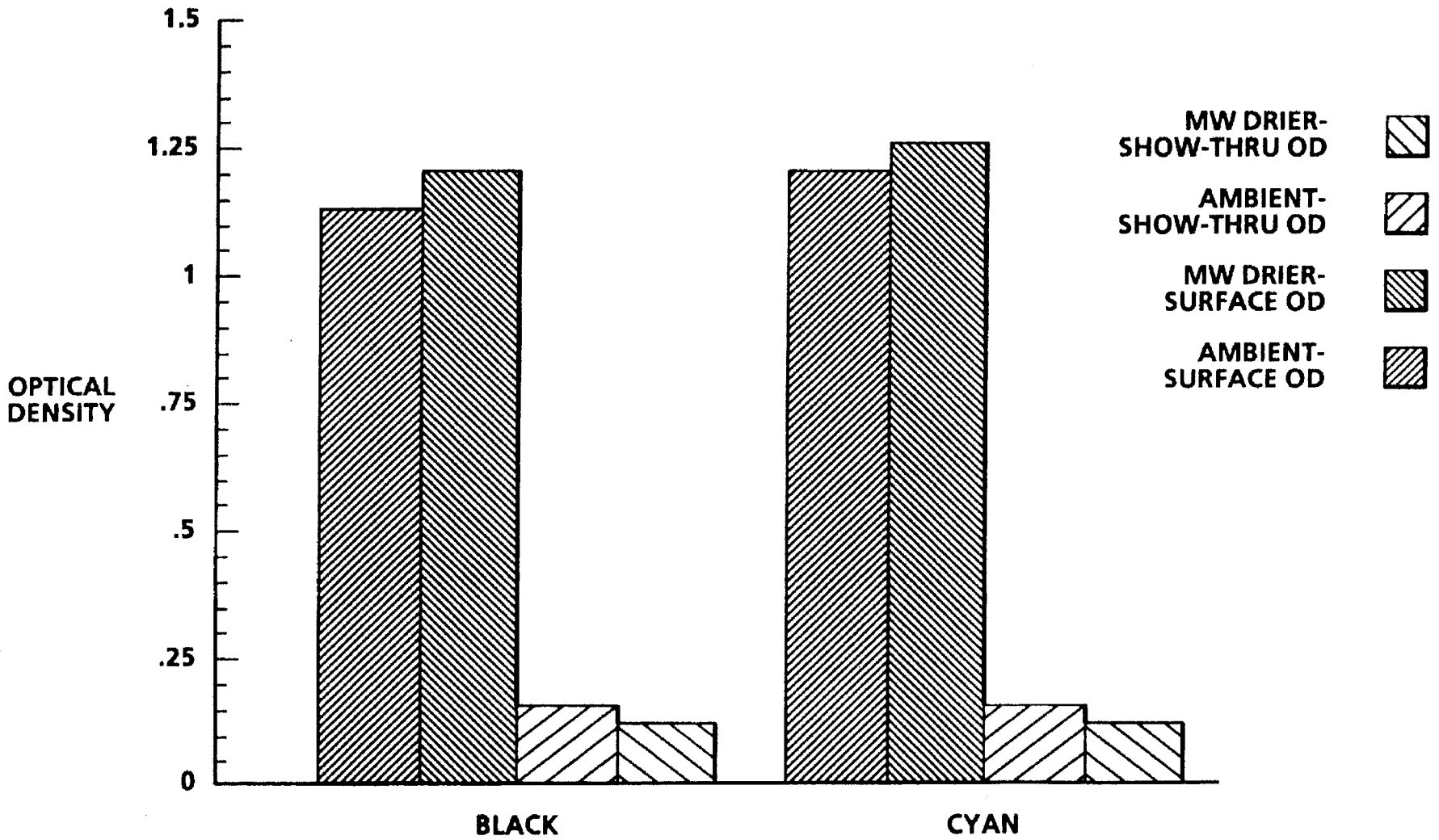
FIG. 5 is a bar graph illustrating surface and show through optical densities for ambient and microwave dried images.

FIG. 5 compares optical density of two different color inks for both ambient (natural air drying) and microwave drying. In the case of surface optical density (on the image side), the density is larger for a fast drying rate due to the lack of ink penetration. In the case of strike through (on the non-image side), the density is less for microwave drying due to fast evaporation rates and reduced penetration. Champion Courtland paper was used in this test with 100% area coverage, full tone, 1.8 mg/cm$^2$ ink density, and the lab ambient was 73° F., 45% RH. Process speed was 7.5 IPS.

Figure 6:
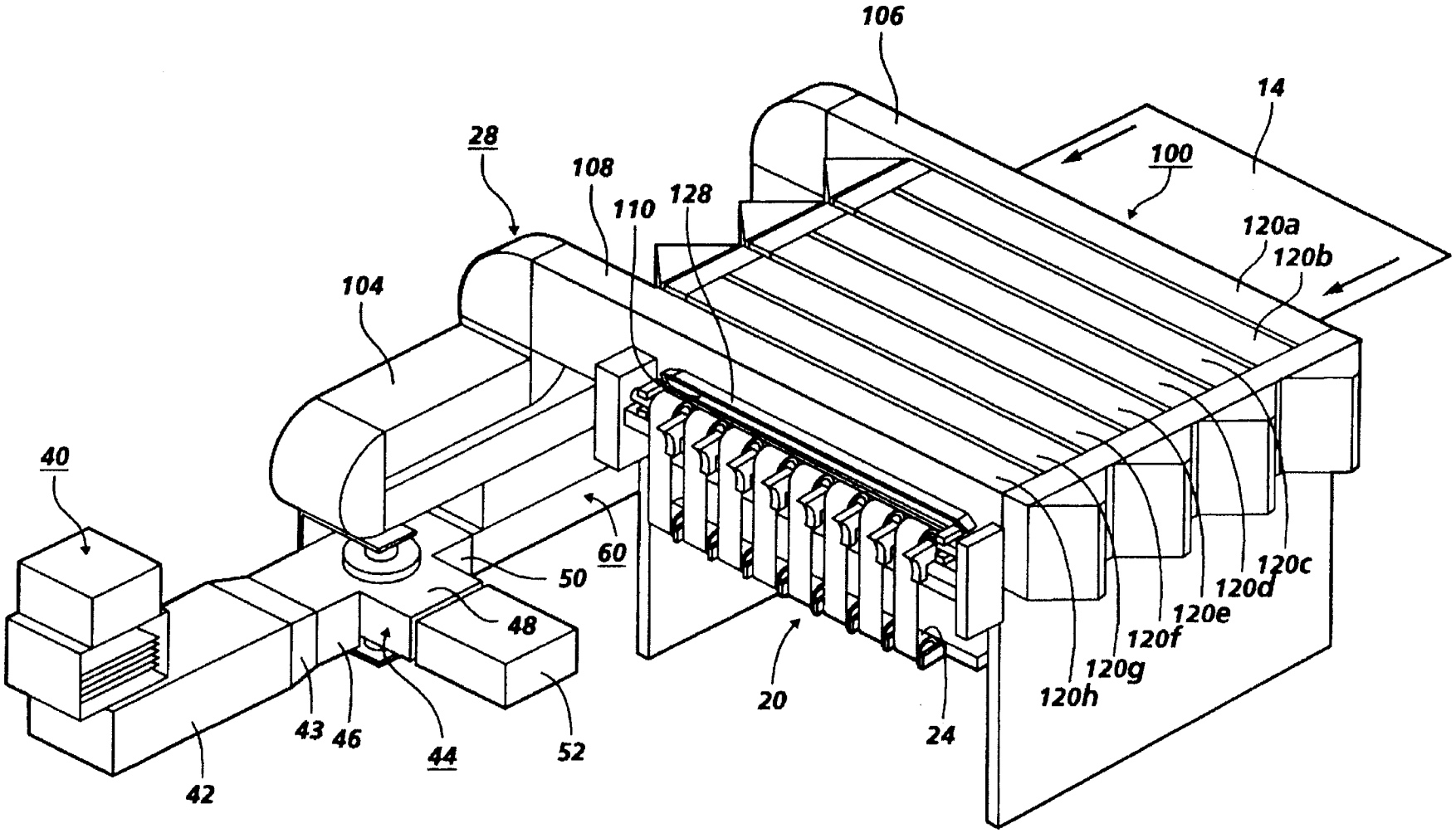
FIG. 6 is a perspective view of a microwave dryer in accordance with the present invention.

FIG. 6 illustrates one embodiment of the microwave dryer 28. The microwave dryer 28 comprises a traveling wave resonator which enhances the field intensity to which the paper is exposed. By using a traveling wave resonator, the electric field intensity sufficient to dry ink effectively is possible with a relatively low power (less than 1.5 kW) magnetron. In addition, because traveling waves are used, uniformity of heating is much better than if standing waves are used and the applicator is not greatly affected by differences in the load or the paper and the amount of ink coverage.

The paper transport mechanism 20 moves paper through the microwave dryer 28 by a belt or plurality of belts carried by the rollers 24. The microwave dryer 28 includes a microwave generator 40 for generating microwaves. The microwave generator 40 includes a 2455 MHz fixed frequency magnetron and a magnetron power supply as is understood by one skilled in the art. Such magnetrons are commonly used in household microwave oven applications and are available from several Japanese manufacturers at low cost. A magnetron generator with a power in the range of approximately 500–1500 watts is preferably used to generate the microwaves.

As seen in FIG. 6, the microwave generator 40 is connected to a waveguide launcher 42. The waveguide launcher 42 is a mount for the magnetron that allows the magnetron to radiate efficiently into a waveguide. The waveguide launcher 42 includes a transition section 43. The transition section 43 connects the output of the launcher 42 to a circulator 44 having a first port 46, a second port 48 and a third port or main waveguide feed 50. The second port 48 is coupled to a matched load 52.

The circulator 44 is used to ensure stable operation of the magnetron under the operating conditions. The circulator is a non-reciprocal ferrite device that allows power to flow from the microwave generator 40 to a microwave applicator. The matched load 52 absorbs reflected power to protect the magnetron 40 from damage. The matched load 52 includes a tuning screw to permit fine tuning of the circuit to have a termination Voltage Standing Wave Ratio (VSWR) of less than 1.02.

Figure 7:
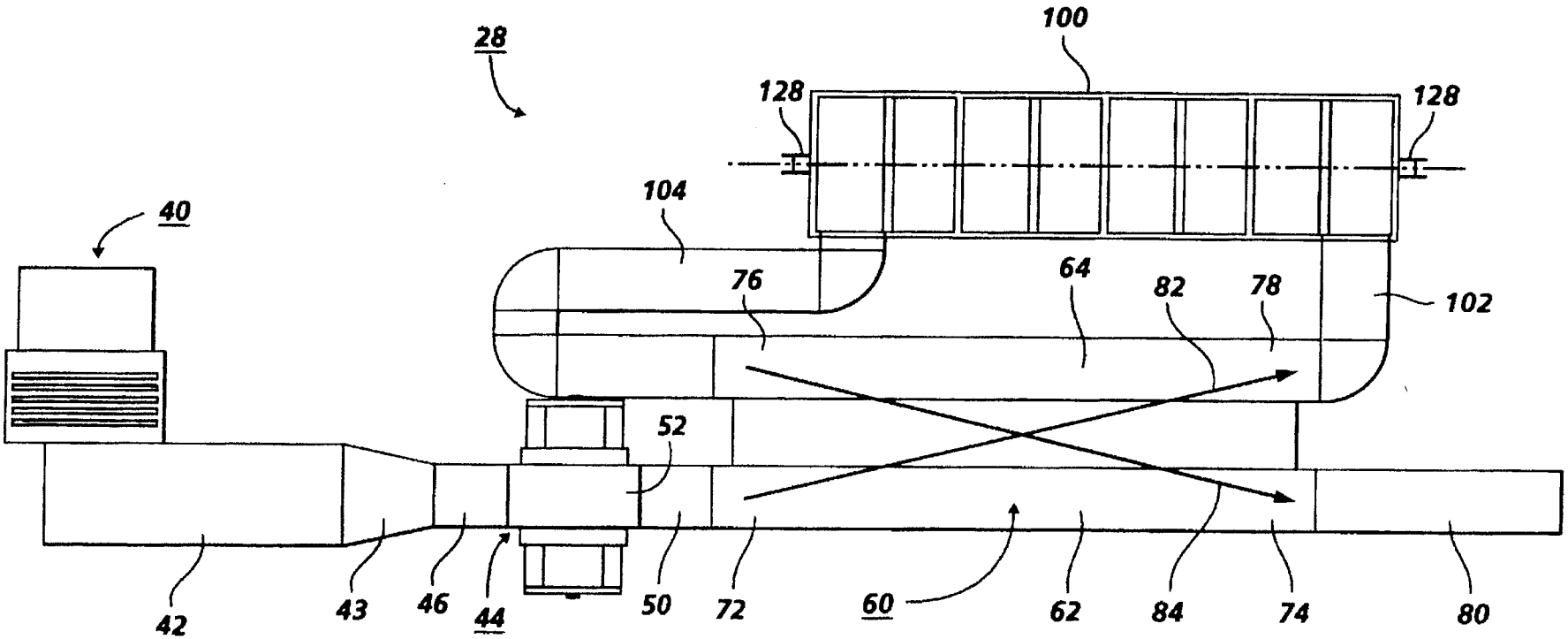
FIG. 7 is an elevational view of the FIG. 6 microwave dryer.
Figure 8:
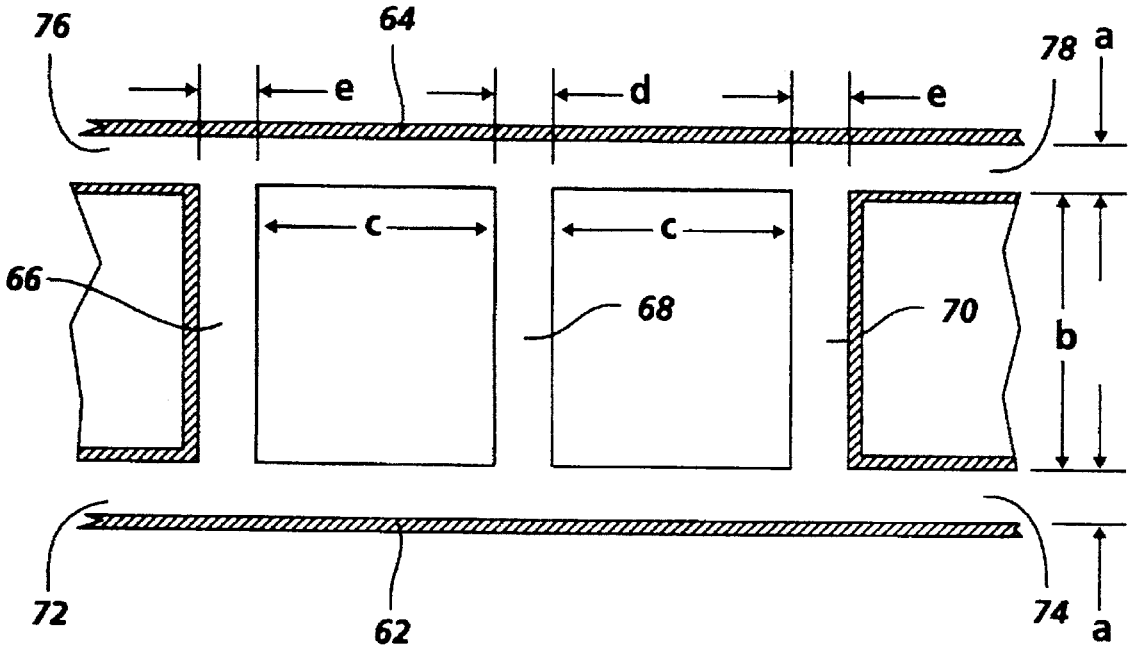
FIG. 8 is a sectional plan view of a three-branch coupler.

A branch guide directional coupler 60 is connected to the main waveguide feed 50 as shown in FIG. 7. The directional coupler 60 comprises a main waveguide 62 and an auxiliary waveguide 64 more clearly seen in FIG. 8. The main and auxiliary waveguides are connected together by a first, a second and a third branch waveguide 66, 68, and 70 respectively. Each of the branch guides is nominally a quarter of a guide wavelength long.

The main waveguide 62 has a first arm 72 and a second arm 74. The auxiliary waveguide 64 has a third arm 76 and a fourth arm 78. When power flows in the main waveguide 62 from the first arm 72, some power will be coupled to the auxiliary waveguide through the branch waveguides 66, 68 and 70 and some power flows out the fourth arm 78. When power flows in the auxiliary waveguide 64 from third arm 76 to the fourth arm 78, some of the power is coupled to the main waveguide and flows out the second arm 74. The extent to which power is coupled between the main and auxiliary waveguides, i.e. the coupling, is determined by the dimensions of the branch guides. Currently, the branch guide directional coupler 60 is a 3.0 dB coupler having the following dimensions: a=1.22 inches; b=1.955 inches; c=1.620 inches; d=0.920 inches; and e=0.523 inches. A matching termination or matched load 80 is coupled to the second arm 74 for terminating thereof. A dummy or matched load suitable for use in the present invention is described in detail in cross-referenced patent application Attorney Docket No. D/92371, U.S. patent application Ser. No. 08/159,358, now U.S. Pat. No. 5,422,463 "Dummy Load for Microwave Dryer" filed concurrently herewith which is herein incorporated by reference.

A first arrow 82 and a second arrow 84 shown in FIG. 7 illustrate the flow of power through the branch guide directional coupler 60. The first arrow 82 illustrates the flow of power from the first arm 72 to the fourth arm 78 and into a serpentine applicator 100. The second arrow 84 illustrates the flow of power from the third arm 76 into the second arm 74 and into the matching termination 80.

The branch guide directional coupler 60 is connected to a serpentine applicator 100 as illustrated in both FIGS. 6 and 7. The serpentine applicator 100 receives microwave power from the fourth arm 78 of the coupler 60 through a first microwave guide 102. Power exiting the serpentine applicator 100 enters the third arm 76 of the coupler 60 through a second microwave guide 104. The second microwave guide 104 can include an adjustable phase shifter for fine tuning the microwave circuit. A suitable phase shifter for use in the present invention is described in detail in cross-referenced patent application Attorney Docket No. D/93144, U.S. patent application Ser. No. 08/160,002, now U.S. Pat. No. 5,410,283 "Phase Shifter for Fine Tuning Microwave Applicator" filed concurrently herewith which is herein incorporated by reference.

Figure 9:
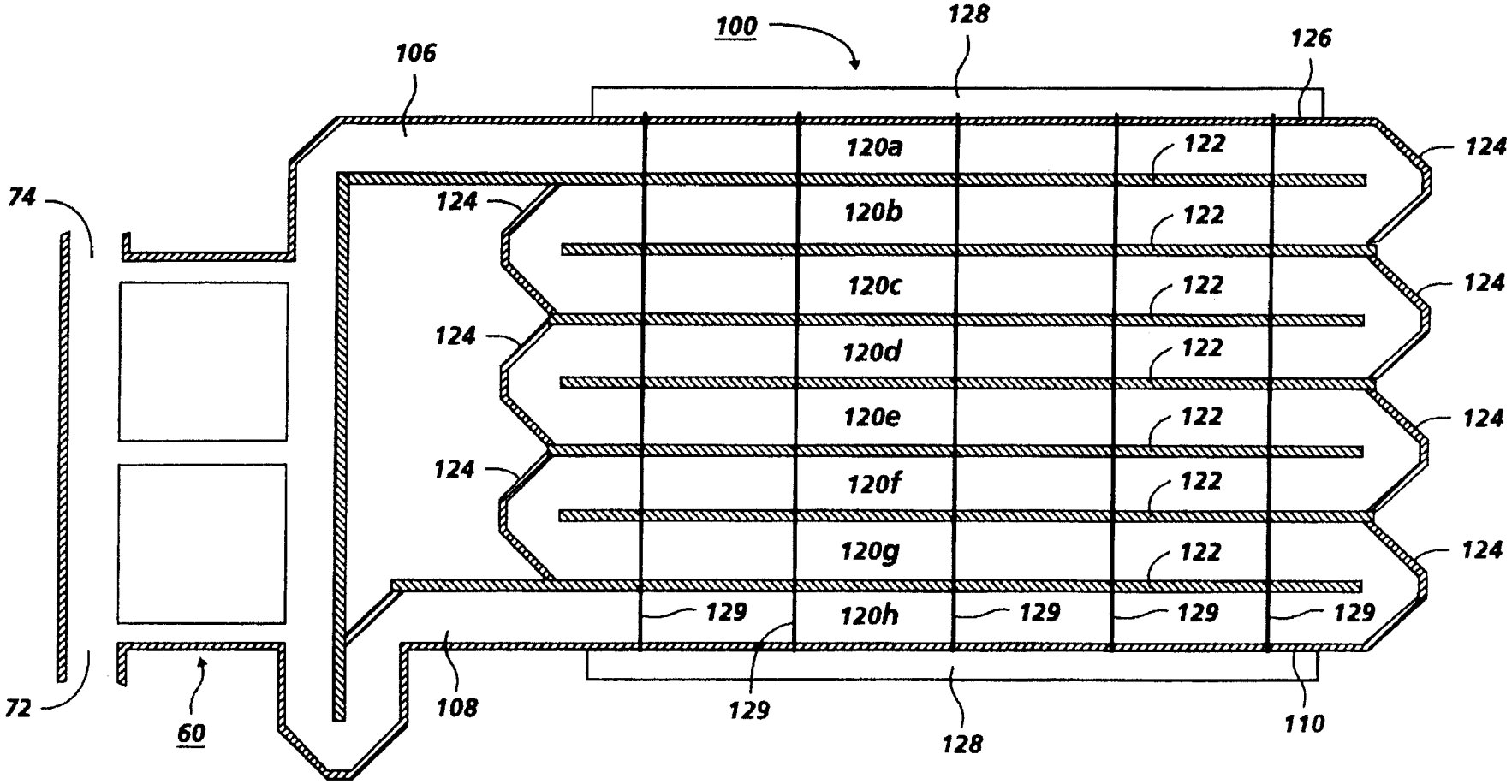
FIG. 9 is a sectional view of a three-branch coupler and an eight pass serpentine applicator in accordance with the present invention.

Returning to FIGS. 6 and 7, the serpentine applicator 100 has an input 106 connected to the first microwave guide 102 and an output 108 connected to the second microwave guide 104. A sheet of paper 14 passes through the serpentine applicator 100 and exits through a slot 110. The paper 14 enters the applicator on the opposite side but is not shown in FIG. 6. As shown in FIG. 9, the serpentine applicator 100 is an eight branch serpentine applicator having generally parallel guide sections or branches **120*a* through 120*h*. Each branch 120 has a height of 2.84 inches and a width of 0.67 inches. As microwave power enters the input 106, the power travels through each branch starting at the first branch 120*a* and ending at the branch 120*h* and to the output 108. The serpentine applicator 100 has a length selected so that the effective electrical length of the traveling wave resonant circuit comprising the serpentine applicator 100 and the directional coupler 60 is equivalent to an integral number of guide wavelengths. With proper adjustment of the length, the microwave circuit becomes a traveling wave circuit resonating at the resonant frequency. In order for the resonant system to function properly, the system resonant frequency and the magnetron frequency must be matched to within a frequency of up to ±5 MHz. In addition, the waveguide launcher 42** includes a tuning screw or a phase shifter to permit a one-time optimization of system performance.

FIG. 9 illustrates a sectional plan view of one-half, of the coupler 60 and the serpentine applicator 100. The coupler 60 and the guides 106 and 108 are shown on the same plane as the serpentine applicator 100 for illustration. The interior of the serially interconnected generally parallel guide sections **120*a* through 120*h* joined by U-shaped connecting sections 124 is also shown. Each guide section 120 is connected to the next and partially separated therefrom by a member 122. The connecting sections 124 transmit the microwave power from one guide section to the next guide section with minimum reflections and loss of power. A sheet of paper enters through a slot 126 which is substantially similar to the slot 110 previously described and exits through the slot 110. Paper guide members comprising microwave transparent material such as Teflon™ or polytetraflouroethylene string are attached to the underneath side of the top half of the serpentine applicator 100 from one slot to the other slot to prevent paper from being caught therein when passing from the slot 126 to the slot 110. In addition, Teflon™ is hydrophobic and consequently does not disturb the ink. Both the slot 126 and the slot 110 are surrounded by a lip member 128 shown in FIGS. 6 and 10. Only one half of the lip is illustrated in FIG. 9. The lip member 128 comprising one-half on the top half and one-half on the bottom half of the serpentine applicator serves as a guide and also as a choke for preventing leakage of microwave power from the serpentine applicator 100**.

As microwave power is transmitted from one guide section to the next, the amount of power available for drying in each guide section changes. A relatively large amount of power is available in the first guide section **120*a*. The amount of power then decreases from one guide section to the next whereby a relatively small amount of power is available in the last guide section 120*h*. For instance, the ratio of electric field strength, in the first guide section 120*a* to electric field strength in the last guide section 120*h*** is approximately 2 to 1.

Consequently, paper printed with inks having rapid penetration rates may be input to the slot 126 and exit the slot 110 to apply the greatest amount of power to the ink/paper as soon as possible. Paper printed with inks having slow penetrating rates, however, may be input to the slot 110 and exit the slot 126 so that the amount of microwave power applied to the ink/paper increases as the paper travels through the applicator 100. By not applying as much power initially, since the paper passes through guide section **120*h*** first, the slower absorbing inks are not heated as rapidly, and so image quality defects, such as mottle and spatter, which can result from slower absorbing inks sitting on the surface of the paper are reduced or prevented altogether. In this way, the final image quality for all types of inks is the same.

Figure 10:
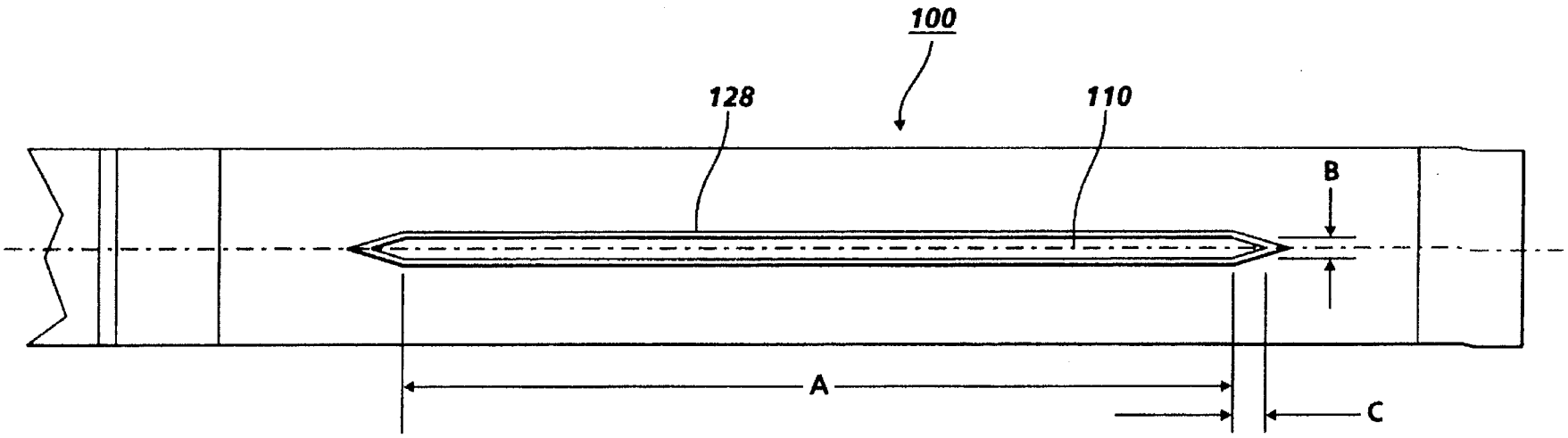
FIG. 10 is a plan view of a paper entrance slot.

FIG. 10 further illustrates the slot 110 and the lip member 128. In the present embodiment, the slot 110 is tapered at each end as illustrated. The length of the slot from the end of the taper to the other end of the taper is eight and one/half inches long shown as dimension A. The height of the slot is 0.25 inches shown as dimension B. The tapers located at either end of slot 110 begin to taper approximately 0.5 inch from the ends. This dimension is shown as C. By tapering the slot, the reflections which occur due to the slot are reduced so that any remaining reflections are not significant.

In addition to the tapered slots 110, each of the slots is surrounded by the lip 128 previously described. The combination of the tapered slot 110 and the lip 128 reduce both VSWR and leakage. The lip 128 minimizes microwave radiation leakage less than 1 mW/sq. cm. The lip serves as a waveguide beyond cutoff for those modes which may be excited in the slot 110.

Figure 11:
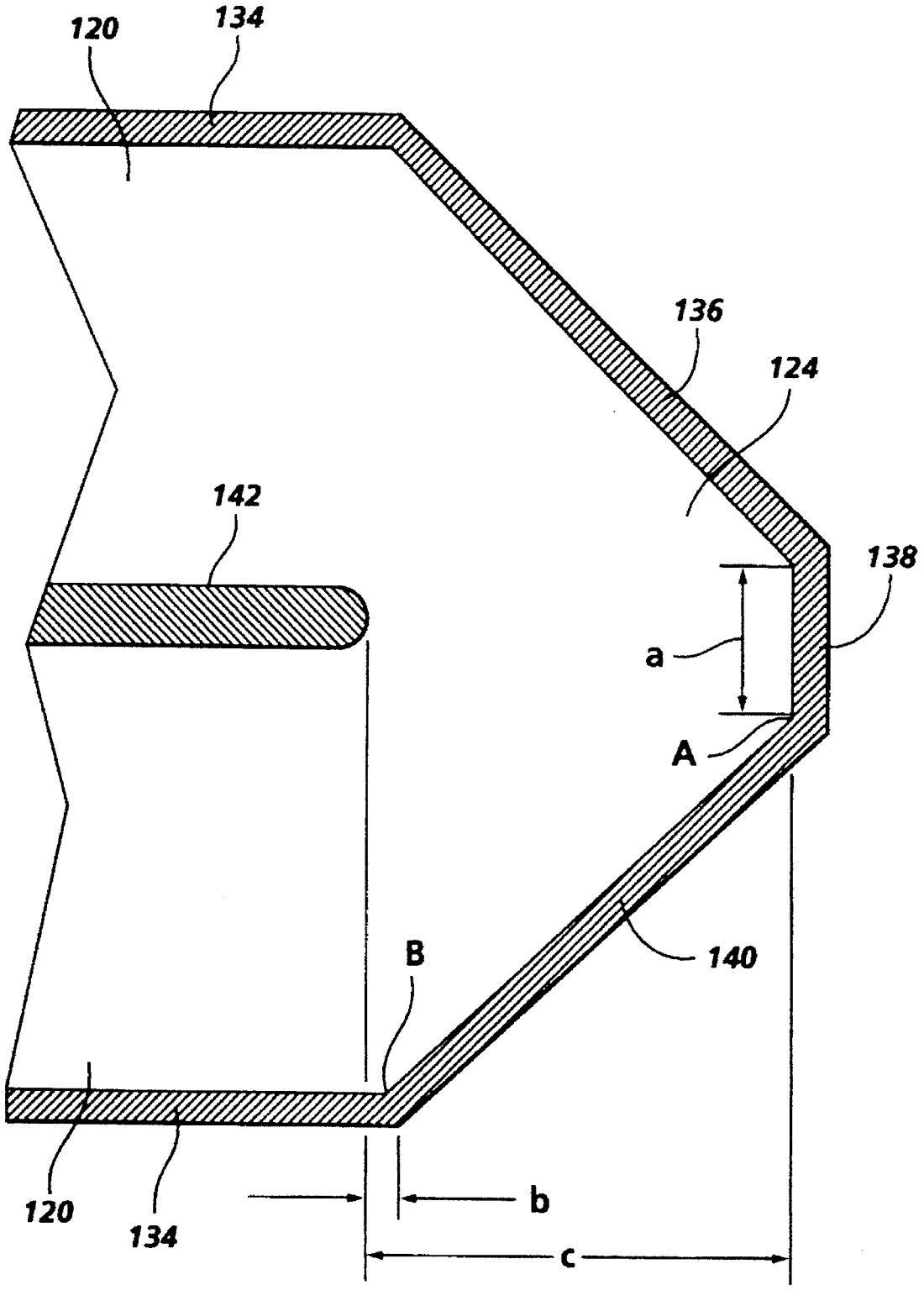
FIG. 11 is a sectional plan view of a U-shaped connecting member of the serpentine applicator.

The microwave applicator 100 is further optimized for the efficient application of microwave power by the U-shaped connecting sections 124 that connect the parallel guide sections 120. A preferred embodiment of the connection of parallel guide sections 120 by the U-shaped connecting section 124 is illustrated in FIG. 11. In this embodiment, a single inner wall 142 separates the parallel guide sections 120. The first, second, and third pieces 136, 138, and 140 comprise the U-shaped guide section 124. The first and third piece 136 and 140 are angled at 135 degrees with respect to the walls 134. The second piece 138, having a dimension a=0.275 inches, connects the pieces 136 and 140. By constructing a U-bend in this configuration with dimensions of b=0.044 inches and c=0.67 inches, there is a substantially complete transmission of the microwave power as the power passes from one parallel guide section 124 to another.

Figure 12:
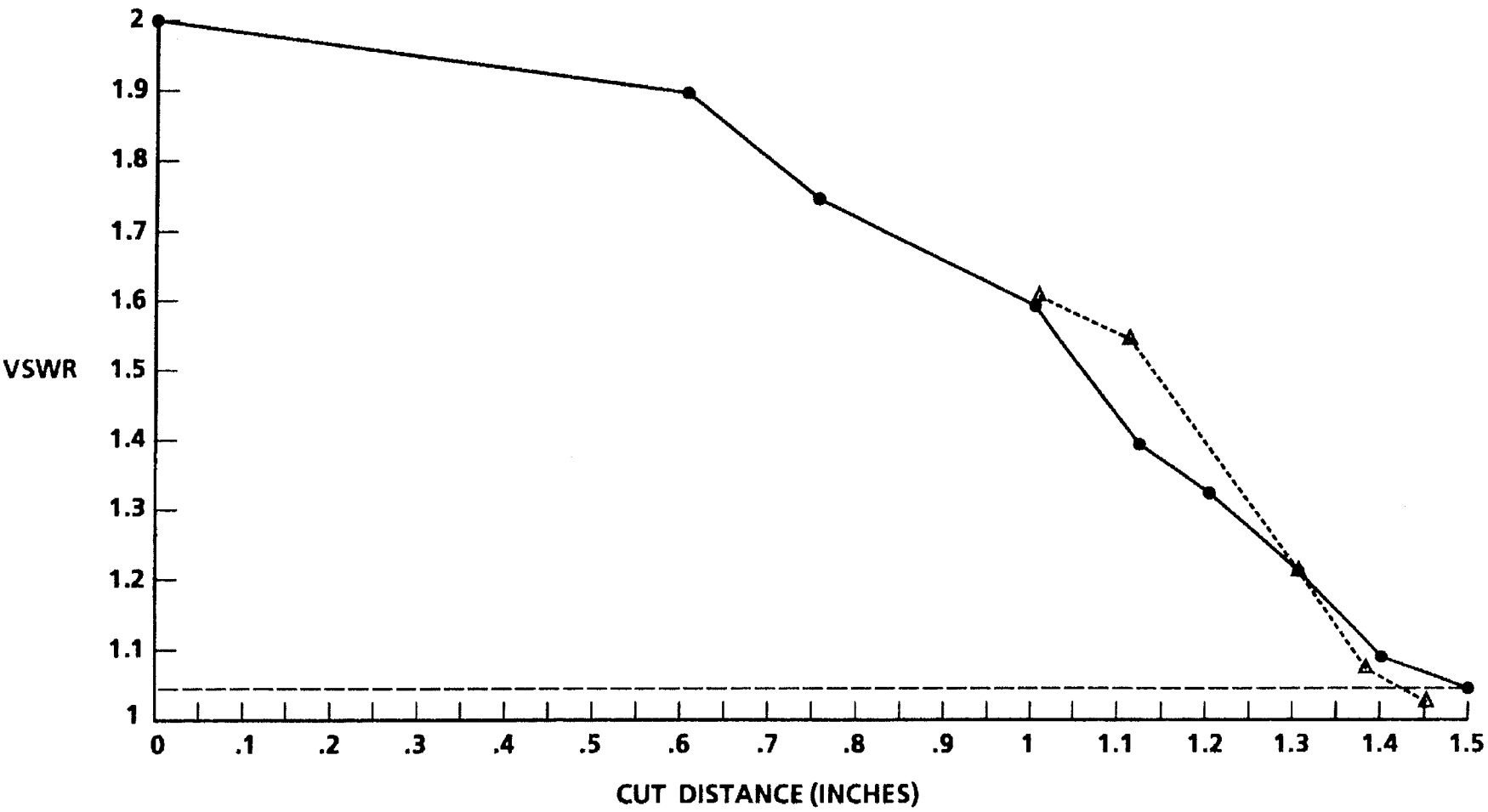
FIG. 12 is a graph showing a reduction in standing wave ratios with respect to the cut distance of the U-shaped connecting member.

The U-shaped connecting sections 124 are optimized to reduce the VSWR (voltage standing wave ratio) as illustrated in FIG. 12. FIG. 12 is a plot of the VSWR versus cut distance. Cut distance is the distance in inches from the end of the second piece 138 at point A to the wall 134 at point B. As illustrated in FIG. 12, as the cut distance approaches 1.4 inches, the VSWR is also reduced in the waveguide having branches with the dimensions of 2.84 inches in height and 0.67 inches in width.

The single inner wall 142 is dimensioned to have a width which is sufficiently wide to choke off any microwave energy from passing from one of the parallel guide sections to another of the parallel guide sections traveling through the slots in the inner walls 142. In the present embodiment, the single inner wall 142 has a width of one-sixteenth of an inch. Double walls are also possible wherein each of the guide sections 120 has a wall and the walls of adjacent guide sections are spaced apart.

Figure 13:
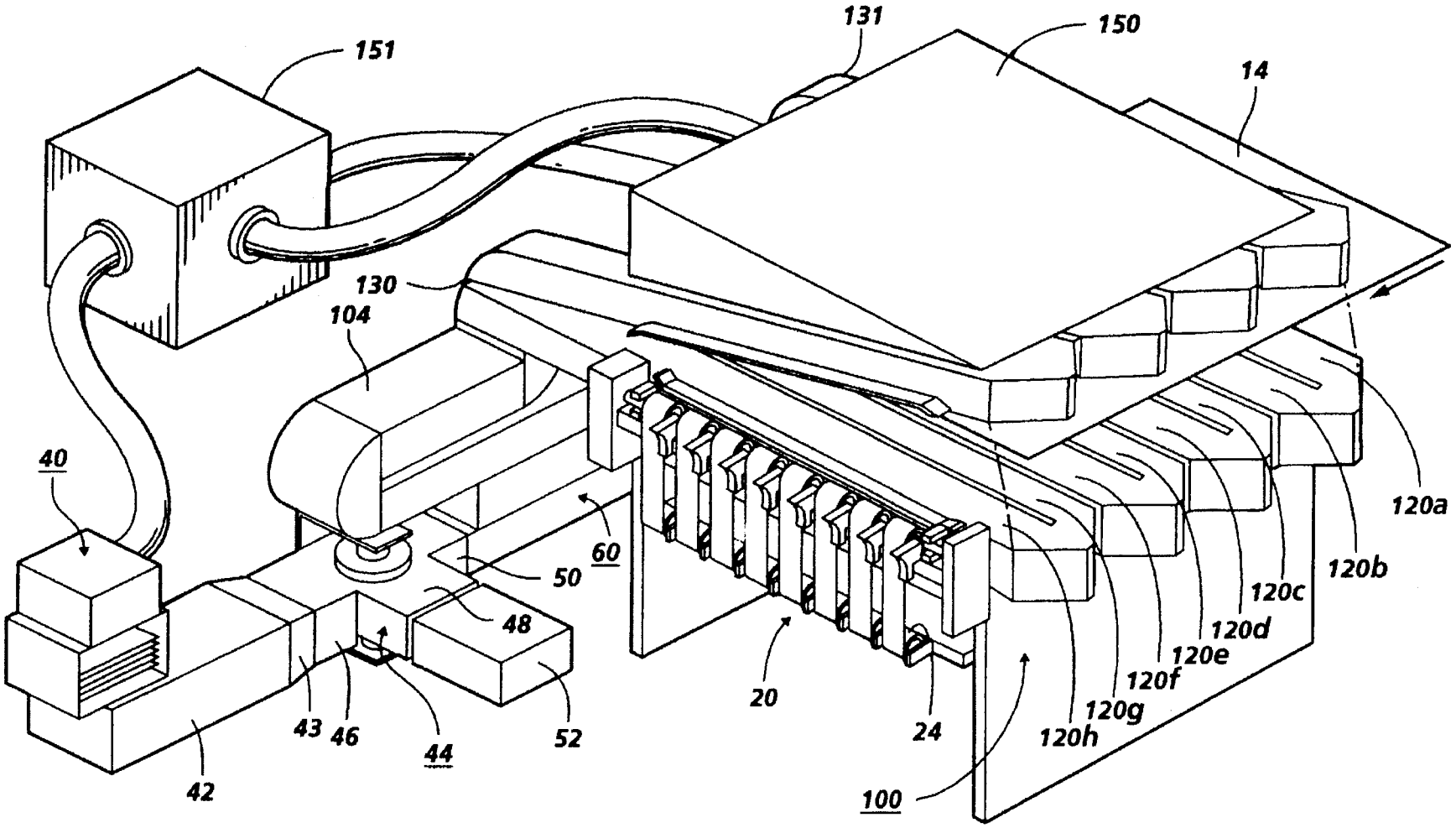
FIG. 13 is a perspective view of a microwave dryer and a manifold of the present invention.
Figure 14:
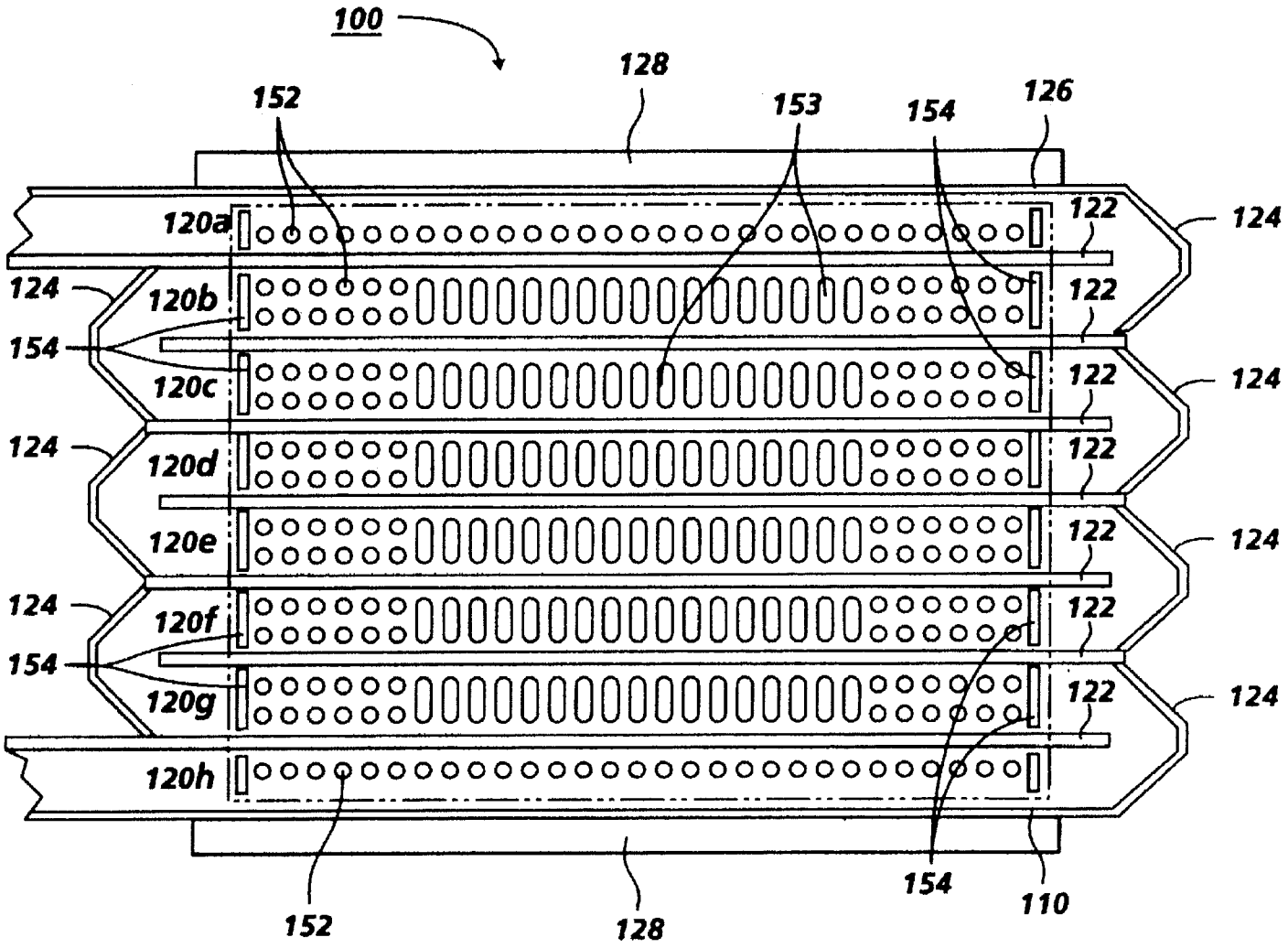
FIG. 14 is a plan view of the serpentine applicator defining holes for the application of convective hot air for drying.

FIG. 13 illustrates the microwave dryer 28 including a manifold 150 which sits atop the serpentine applicator 100. In this embodiment, the applicator 100 is hinged at locations 130 and 131 to provide access to the interior thereof for paper removal if necessary. At 130 and 131 there are compressible conductive elastomer gaskets to provide good electrical contact once the upper half is closed. In the figure, the applicator 100 and manifold 150 are shown in a raised position. The manifold 150 supplies forced hot air to the top surface of the paper to provide convective hot air drying. Hot air is scavenged from the magnetron 40 and the matching termination 80 and forced by a blower 151 into the manifold 150. The manifold 150 is shaped like a wedge in which the height at the portion receiving forced air from the blower 151 is greater than the height at the distant end thereof. By angling the top surface of the manifold 150, the serpentine applicator may be opened without being obstructed by the manifold due to any frame or machine which may be located above the manifold 150. The hot air passes through a plurality of holes 152 and/or slots 153 defined in the top of the serpentine applicator 100 as illustrated in FIG. 14. FIG. 14 also illustrates the interior of the serpentine applicator located above the side of paper having wet ink. Hot air impinges upon the wet surface of the sheet of paper through the holes 152 and slots 153. A plurality of microwave transparent baffles 154, made of a microwave transparent material such as polystyrene, directs the flow of air to the sheet. Air is removed by means of a vacuum transport which is located below the bottom half of the applicator.

The holes and slots are sized to reduce or prevent microwave leakage from and/or reflections in the waveguides 120. In the present embodiment, the holes are 3 mm in diameter and the slots are 3 mm wide and 9 mm long. Other combinations of holes and slots can be used, but it has been found the slots allow for increased air flow to a sheet of paper for drying.

With a power output of the magnetron 40 of approximately 850 watts, a minimum of approximately 150 watts of thermal power is potentially available from the matched loads and the magnetron due to its inherent inefficiencies. The magnitude of the power available from the matched load depends on the area coverage of ink on the paper. For instance, with low area coverage (20%) approximately 250 watts is dissipated in the termination and for high area coverage (greater than 60%) less than 50 watts is dumped into the matching termination. Thus energy from the termination 80 is not fixed.

The amount of power dissipated in the matching termination 80 depends on the amount of ink deposited on the sheet 14 and the type of coupler 60. It is possible to design a system in which no power is dissipated in the matching termination 80 if the amount of ink deposited on the paper is a known quantity each time. In such a system, the coupler 60 can be designed to couple the required amount of power to the applicator 100 so that no excess power is absorbed by the termination 80. If the ink covered paper is not a matched load, then microwave power which is absorbed in the termination and converted to thermal power can be recycled for convective drying. Consequently, since ink coverage varies over a wide range, the present invention has a wide latitude in drying all types of printed sheets.

In recapitulation, it is evident that a microwave drying apparatus having the features of the present invention incorporated herein is capable of controlling paper deformation caused by printing with liquid inks. The application of microwave energy to such an ink-laden substrate effectively prevents the formation of cockle and other paper deforming conditions.

It is, therefore, apparent that there has been provided in accordance with the present invention, an apparatus and method for controlling paper deformation due to ink jet printing that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for drying ink deposited on a cut sheet of paper, said apparatus comprising:

a microwave generating member being adapted to generate microwave energy of a predetermined frequency;

a resonant traveling wave applying member, having a length selected according to an integral number of wavelengths in said member at the predetermined frequency, including a serpentine applicator, connected to said microwave generating member, being adapted to apply microwave energy in the form of resonant traveling waves to the cut sheet of paper having ink deposited thereon; and a transport member having a low dielectric constant for transporting the cut sheet of paper through said applying member to dry the ink deposited on the cut sheet of paper.

2. The apparatus of claim 1, wherein said transport member comprises a belt.

3. The apparatus of claim 2, wherein said applying member defines an input slot to receive a sheet of paper having deposited thereon liquid ink and defining an output slot to produce a sheet of paper on which substantially liquid free ink remains.

4. The apparatus of claim 3, wherein said applying member comprises a directional coupler connected between said microwave generating member and said serpentine applicator.

5. The apparatus of claim 4, wherein said microwave generating member generates microwaves having a power in the range of 500 to 1500 watts.

6. The apparatus of claim 5, wherein said serpentine applicator comprises:

a plurality of wall members; and a plurality of U-shaped connecting members joining each of the wall members of said plurality of wall members to define a plurality of generally parallel waveguides.

7. The apparatus of claim 6, wherein the defined generally parallel waveguides range from 4 to 8 in number.

8. The apparatus of claim 6, wherein said serpentine applicator comprises a top member located on one side of said belt and a bottom member located on the opposite side of said belt.

9. The apparatus of claim 8, further including a guide member coupled to said top member to guide the cut sheet of paper from the input slot to the output slot.

10. The apparatus of claim 9, wherein said guide member comprises a polytetraflouroethylene string extending substantially perpendicular to the wall members and having one end thereof connected to said applying member in the region of the the input slot and the other end thereof connected to said applying member in the region of the output slot.

11. The apparatus of claim 10, wherein said top member and said bottom member are hingedly connected to provide access to the interior of said applying member.

12. The apparatus of claims 8, further comprising a drying member coupled to said top half to deliver a flow of air to the paper.

13. The apparatus of claim 12, wherein said top member defines a plurality of holes to permit delivery of air to the interior chamber of said applying member, each of said plurality of holes being of a size selected to reduce microwave leakage therefrom.

14. The apparatus of claim 13, wherein said drying member comprises a manifold defining a chamber attached to said top half and a blower coupled to said manifold to deliver air to the interior chamber.

15. The apparatus of claim 6, wherein said wall members comprise a single member shared by adjacent ones of the generally parallel waveguides.

16. The apparatus of claim 15, wherein said common wall members are of a thickness sufficient to prevent microwave passage through the slots between adjacent waveguides.

17. The apparatus of claim 16, wherein said U-shaped connecting members are optimized to reduce the standing wave ratio by optimizing the distance between the end of said wall member and the interior surface of said U-shaped connecting member.

18. The apparatus of claim 17, further comprising a lip member attached to said applying member at the input slot for reducing microwave leakage from said applying member.

19. The apparatus of claim 17, further comprising a lip member attached to said applying member at the output slot for reducing microwave leakage from said applying member.

20. A method for drying ink deposited on a cut sheet of paper, comprising the steps of:

applying microwave energy comprising resonating traveling microwaves to the deposited ink within no more than 3 seconds after depositing the ink on the cut sheet of paper with a microwave dryer including a traveling wave resonant circuit having an effective electrical length equivalent to an integral number of wavelengths, generating resonating traveling microwaves; and removing excess liquid from the deposited ink within no more than 5 seconds after said applying step.

21. The method of claim 20, wherein said applying step includes applying microwave energy by a microwave dryer comprising a microwave generator, a directional coupler and a serpentine applicator, said directional coupler connected between said microwave generating member and said serpentine applicator.

22. The method of claim 21, wherein said applying step includes applying microwaves having a power in the range of about 500–1500 watts.

23. The method of claim 22, wherein said applying step includes applying microwave energy to the deposited ink within no more than 0.5 to 1.5 seconds after depositing the ink.

24. The method of claim 23, further comprising the step of passing the cut sheet of paper to the dryer at a speed of between about 2 inches to 20 inches per second.

25. The method of claim 24, wherein said removing step requires a time period of about 5 seconds to 0.5 seconds.

26. A printing machine, comprising:

an ink jet print head adapted to deposit ink on a cut sheet of paper;

a microwave dryer, associated with said ink jet print head, for drying the ink deposited on the cut sheet of paper deposited by said print head, said dryer including a microwave generating member being adapted to generate microwave energy of a predetermined frequency, and a resonating traveling wave applying member having a length selected according to an integral number of wavelengths in said member at the predetermined frequency, including a serpentine applicator, connected to said microwave generating member to apply microwave power in the form of resonant traveling waves to the cut sheet of paper having deposited thereon ink; and a transport member having a low dielectric constant for transporting the cut sheet of paper through said applying member to dry the ink deposited on the cut sheet of paper.

27. The printing machine of claim 26, wherein said transport member comprises a belt.

28. The printing machine of claim 27, wherein said applying member defines an input slot to receive a sheet of paper having deposited thereon liquid ink and defining an output slot to output a sheet of paper having deposited thereon substantially liquid free ink.

29. The printing machine of claim 26, wherein said applying member comprise a directional coupler connected between said microwave generating member and said serpentine applicator.

30. The printing machine of claim 29, wherein said microwave generating member generates microwaves having a power in the range of 500 to 1500 watts.

31. The printing machine of claim 30, wherein said serpentine applicator comprises a plurality of wall members; and a plurality of U-shaped connecting members joining each of the wall members of said plurality of wall members to define a plurality of generally parallel waveguides.

32. The printing machine of claim 31, wherein the defined generally parallel waveguides range from 4 to 8 in number.

33. The apparatus of claim 27, wherein said ink jet printhead is adapted to deposit an ink composition including compounds designed to couple with microwave power.

34. The apparatus of claim 33, wherein said ink composition includes an aqueous liquid vehicle, a colorant, and an ionic compound at least partially ionizable in the liquid vehicle, said ink composition having a conductivity of at least about 10 millisiemens per centimeter.

35. A method of printing and drying ink on a cut sheet of paper comprising the steps of:

depositing ink on the cut sheet of paper by an ink jet printhead;

passing the cut sheet of paper to a microwave dryer, including a traveling wave resonant circuit having an effective electrical length equivalent to an integral number of wavelengths, immediately after the deposition of ink on the cut sheet of paper; and heating the ink rapidly by microwave power comprising resonating traveling microwaves applied by the microwave dryer to evaporate excess liquid from the ink before substantial absorption into the paper within no more than 5 seconds from depositing ink on the paper.

36. The method of claim 35, wherein said heating step includes heating by microwaves applied by a microwave dryer comprising a microwave generator, a directional coupler and a serpentine, said directional coupler connected between said microwave generating member and said serpentine applicator.

37. The method of claim 36, wherein said heating step includes heating by microwaves having a power output in the range of about 500–1500 watts.

38. The method of claim 37, wherein the heating step includes evaporating liquid in the ink within about 5 seconds to 0.5 seconds from completion to said depositing step.

39. The method of claim 38, wherein the passing step includes the cut sheet of paper to the microwave dryer at a speed of between about 2 inches to 20 inches per second.

40. A method of printing paper with ink and drying the printed paper with microwave power applied with a serpentine applicator having a plurality of generally parallel guide sections, wherein the microwave power decreases from a first guide section to a last guide section, said method comprising the steps of:

depositing a slowly penetrating liquid ink on the cut sheet of paper by a printhead; and passing the printed paper through the serpentine applicator to dry the ink thereon by applying microwave power comprising resonating traveling microwaves so that the printed paper passes through the last guide section first.

41. The method of claim 40, wherein said depositing step includes depositing the slowly penetrating liquid ink with a thermal ink jet printhead.

* * * * *